US008498746B2

(12) United States Patent
James et al.

(10) Patent No.: US 8,498,746 B2
(45) **Date of Patent: *Jul. 30, 2013**

(54) SOOTBLOWING OPTIMIZATION FOR IMPROVED BOILER PERFORMANCE

(75) Inventors: John Robert James, Lynn, MA (US); John McDermott, Boston, MA (US); Stephen Piche, Austin, TX (US); Fred Pickard, Norfolk, MA (US); Neel J. Parikh, Cleveland, OH (US)

(73) Assignee: NeuCo, Inc., Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/606,311

(22) Filed: Sep. 7, 2012

(65) Prior Publication Data

US 2013/0018831 A1 Jan. 17, 2013

Related U.S. Application Data

(62) Division of application No. 11/868,021, filed on Oct. 5, 2007, now Pat. No. 8,340,824.

(51) Int. Cl.
*G06N 5/02* (2006.01)

(52) U.S. Cl.
USPC ..... 700/274; 700/266; 702/31; 702/32; 422/2; 422/62; 422/105; 436/3; 436/55; 122/379; 122/390; 122/392; 15/316.1; 15/317; 15/318; 15/318.1

(58) Field of Classification Search
USPC ..... 700/266, 274; 702/31, 32; 422/2, 422/62, 105; 435/3; 436/3, 55; 122/379, 390, 122/392; 15/316.1–318.1
See application file for complete search history.

(56) References Cited

U.S. PATENT DOCUMENTS

| | | | | |
|---|---|---|---|---|
| 3,898,441 | A | 8/1975 | Davis et al. | 700/287 |
| 4,965,742 | A | 10/1990 | Skeirik | 700/86 |
| 4,985,824 | A | 1/1991 | Husseiny | 700/86 |
| 5,167,009 | A | 11/1992 | Skeirik | 395/27 |
| 5,181,482 | A | 1/1993 | Labbe et al. | 122/392 |
| 5,212,765 | A | 5/1993 | Skeirik | 395/11 |
| 5,224,203 | A | 6/1993 | Skeirik | 706/23 |
| 5,282,261 | A | 1/1994 | Skeirik | 395/22 |
| 5,386,373 | A | 1/1995 | Keeler et al. | 364/577 |
| 5,471,381 | A | 11/1995 | Khan | 700/48 |
| 5,493,631 | A | 2/1996 | Huang et al. | 706/23 |
| 5,704,011 | A | 12/1997 | Hansen | 706/25 |
| 5,781,432 | A | 7/1998 | Keeler et al. | 364/164 |
| 5,819,246 | A | 10/1998 | Ashida et al. | 706/25 |
| 5,822,740 | A | 10/1998 | Haissig | 706/3 |
| 5,933,345 | A | 8/1999 | Martin et al. | 364/164 |
| 6,002,839 | A | 12/1999 | Keeler | 706/23 |
| 6,038,540 | A | 3/2000 | Krist et al. | 705/8 |

(Continued)

OTHER PUBLICATIONS

Anonymous, "Intelligent Sootblowing at TVA's Bull Run Plant," Electric Power Research Institute, Dec. 2003.

(Continued)

*Primary Examiner* — Brian R Gordon
*Assistant Examiner* — Shogo Sasaki
(74) *Attorney, Agent, or Firm* — Kusner & Jaffe

(57) ABSTRACT

A sootblowing control system that uses predictive models to bridge the gap between sootblower operation and boiler performance goals. The system uses predictive modeling and heuristics (rules) associated with different zones in a boiler to determine an optimal sequence of sootblower operations and achieve boiler performance targets. The system performs the sootblower optimization while observing any operational constraints placed on the sootblowers.

15 Claims, 13 Drawing Sheets

U.S. PATENT DOCUMENTS

| | | | | |
|---|---|---|---|---|
| 6,063,292 | A | 5/2000 | Leung | 210/739 |
| 6,241,435 | B1 | 6/2001 | Huang et al. | 409/141 |
| 6,243,696 | B1 | 6/2001 | Keeler et al. | 706/21 |
| 6,278,899 | B1 | 8/2001 | Piche et al. | 700/44 |
| 6,325,025 | B1 | 12/2001 | Perrone | 122/379 |
| 6,425,352 | B2 | 7/2002 | Perrone | 122/379 |
| 6,438,430 | B1 | 8/2002 | Martin et al. | 700/28 |
| 6,532,454 | B1 | 3/2003 | Werbos | 706/14 |
| 6,539,343 | B2 | 3/2003 | Zhao et al. | 702/190 |
| 6,583,964 | B1 | 6/2003 | Huang et al. | 360/294.4 |
| 6,668,201 | B1 | 12/2003 | Bonissone et al. | 700/50 |
| 6,721,606 | B1 | 4/2004 | Kaji et al. | 700/17 |
| 6,725,208 | B1 | 4/2004 | Hartman et al. | 706/23 |
| 6,736,089 | B1 | 5/2004 | Lefebvre et al. | 122/379 |
| 6,738,677 | B2 | 5/2004 | Martin et al. | 700/44 |
| 6,757,579 | B1 | 6/2004 | Pasadyn | 700/108 |
| 6,823,675 | B2 | 11/2004 | Brunell et al. | 60/773 |
| 7,117,046 | B2 | 10/2006 | Boyden et al. | 700/52 |
| 2003/0109951 | A1 | 6/2003 | Hsiung et al. | 700/108 |
| 2003/0195641 | A1 | 10/2003 | Wojsznis et al. | 700/42 |
| 2003/0217021 | A1 | 11/2003 | Jacobson | 706/16 |
| 2004/0133531 | A1 | 7/2004 | Chen et al. | 706/8 |
| 2004/0170441 | A1 | 9/2004 | Forbes et al. | 399/27 |
| 2004/0244729 | A1 | 12/2004 | Lefebvre et al. | 122/379 |
| 2004/0249480 | A1 | 12/2004 | Lefebvre et al. | 700/31 |
| 2006/0178762 | A1 | 8/2006 | Wroblewski et al. | 700/30 |

OTHER PUBLICATIONS

Anonymous, "Intelligent Sootblowing Demonstration at Texas Glenco's W.A. Parish Plant," Electric Power Research Institute, Dec. 2003.

Chen et al., "Nonlineary Neural Network Internal Model Control with Fuzzy Adjustable Parameter," IEEE International Conference on Industrial Technology, 1996.

Davidson, I., "Intelligent Sootblowing—The potential efficiency gains can be large," BMS (International) Ltd.

Duane Hill, "FEGT System Tests and Overview of ISB at JP Madgett Station" EPRI's Fourth Intelligent Sootblowing Workshop Proceedings, Palo Alto, CA, Mar. 19-21, 2002.

G.G. Yen, "Decentralized Neural Controller Design for Space Structural Platforms," IEEE Conference on Systems, Man and Cybernetics, Human Information and Technology, 3:2126-2131 (1994).

G.G. Yen, "Optimal Tracking Control in Flexible Pointing Structures," IEEE Conference on Systems, Man and Cybernetics, Intelligent Systems for the 21st Century, 5:4440-4445 (1995).

Hesnon, M. and Seborg, D., "Nonlineary Model Predictive Control," Prentice Hall, 1997.

Lin et al., "Hybrid Adaptive Fuzzy Control Wing Rock Motion System and H Robust Performance," IEEE International Conference on Industrial Technology, 2003.

M. Rhode, N. Parikh, "Tampa Electric's Neural Network Based Intelligent Sootblowing," in Proceedings of the 2003 POWER-GEN International Conference, Las Vegas, Nevada, USA, Dec. 9-11, 2003.

M. Rhode, N. Parikh, "Tampa Electric's Neural Network Based Intelligent Sootblowing," in Proceedings of the EPRI's 4th Intelligent Sootblowing Workshop and Exposition, Houston, Texas, USA, Mar. 19-21, 2002.

M. Rhode, N. Parikh, B. Radl, "Neural Net Systems—Sootblowing Optimization Using Advanced Techniques," in Proceedings of the Electric Power 2003, 5th Annual Conference and Exhibition, Houston, Texas, USA Mar. 4-6, 2003.

N. Parikh, M. Rhode "Combustion and Sootblowing Optimization using Advanced Instrumentation, Control and Artificial Intelligence Techniques," in Proceedings of the 29th International Technical Conference on Coal Utilization & Fuel Systems, Clearwater, Florida, USA, Apr. 18-23, 2004.

Nakoneczney et al., "Implementing B&W's Intelligent Sootblowing system at MidAmerican Energy Company's Louisa Energy Center Unit 1," Western Fuels conference, Aug. 12-13, 2002.

Nakoneczny, G., Conrad, R., et al., "Boiler Performance Improvement Due to Intelligent Sootblowing Utilizing Real-Time Boiler Modeling," in Proceedings of Power-Gen International 2004, Orlando, FL, Nov. 30-Dec. 2, 2004.

Neel Parikh and Brad Radl "Intelligent Sootblowing—Pegasus Perspective" EPRI's Twelfth Heat Rate Improvement Conference Proceedings, Palo Alto, CA, Jan. 2001 pp. 378-387.

Piche et al., "Nonlinear Model Predictive Control Using Neural Network," IEEE Control Systems, pp. 53-62, Jun. 2000.

Rhode et al., "Tampa Electric Neural Network Sootblowing," DOE Award Number: DE-FC26-02NT41425, Feb. 2003.

Romero et al., "Combined Optimization for $NO_x$ Emissions, Unit Heat Rate and Slagging Control with Coal-Fired Boilers," Abstract Lehigh University.

Sarunac et al., "Sootblowing Optimization and Intelligent Sootblowing," 4th Intelligent Sootblowing Workshop, Houston, TX, Mar. 2002.

Sarunac et al., "Sootblowing Optimization Helps Reduce Emissions from Coal-Fired Utility Boilers," Proceeding of the 2003 MEGA Symposium, Washington D.C., May 19-22, 2003.

Sarunac et al., "Sootblowing Optimization in Coal-Fired Utility Boilers," 13th EPRI Heat Rate Improvement Conference, Birmingham, AL, Jan. 2003.

Shinskey, F.G,, "Controlling Multivariable Processes," Instrument Society of America, 1981.

Shinskey, F.G., "Process Control Systems," McGraw-Hill, 1979.

Stallings, J., Fifth Intelligent Sootblowing Workshop, Electric Power Research Institute, Jun. 2004, Palo Alto, CA.

| PROPOSE RULES | |
|---|---|
| **Rule 1**<br>**If**<br>Trigger Conditions:<br>superheat sprays > threshold<br>superheat temperature > threshold<br>reheat temperature > threshold<br>Enabling Conditions:<br>furnace min time since last blow > threshold<br>furnace media is available<br>unit is above minimum load<br>**Then**<br>Proposed Action:<br>clean furnace zone (rank 1) | **Rule 3**<br>**If**<br>Trigger Conditions:<br>superheat sprays > threshold<br>superheat temperature > threshold<br>not reheat temperature > threshold<br>Enabling Conditions:<br>reheat min time since last blow > threshold<br>convection media is available<br>opacity is not high<br>unit is above minimum load<br>**Then**<br>Proposed Action:<br>clean reheat zone (rank 3) |
| **Rule 2**<br>**If**<br>Trigger Conditions:<br>superheat sprays > threshold<br>not superheat temperature > threshold<br>reheat temperature > threshold<br>Enabling Conditions:<br>superheat min time since last blow > threshold<br>convection media is available<br>unit is above minimum load<br>**Then**<br>Proposed Action:<br>clean superheat zone (rank 2) | **Rule 4**<br>**If**<br>Trigger Conditions:<br>reheat sprays > threshold<br>superheat temperature > threshold<br>reheat temperature > threshold<br>Enabling Conditions:<br>furnace min time since last blow > threshold<br>furnace media is available<br>unit is above minimum load<br>**Then**<br>Proposed Action:<br>clean furnace zone (rank 4) |

FIG. 5A

| PROPOSE RULES | |
|---|---|
| **Rule 5**<br>**If**<br>Trigger Conditions:<br>reheat sprays > threshold<br>not superheat temperature > threshold<br>reheat temperature > threshold<br>Enabling Conditions:<br>superheat min time since last blow > threshold<br>convection media is available<br>unit is above minimum load<br>**Then**<br>Proposed Action:<br>clean superheat zone (rank 5) | **Rule 7**<br>**If**<br>Trigger Conditions:<br>air preheater differential pressure > threshold<br>Enabling Conditions:<br>air preheater min time since last blow > threshold<br>air preheater media is available<br>opacity is not high<br>**Then**<br>Proposed Action:<br>clean air preheater (rank 7) |
| **Rule 6**<br>**If**<br>Trigger Conditions:<br>reheat sprays > threshold<br>superheat temperature > threshold<br>not reheat temperature > threshold<br>Enabling Conditions:<br>reheat min time since last blow > threshold<br>convection media is available<br>opacity is not high<br>unit is above minimum load<br>**Then**<br>Proposed Action:<br>clean reheat zone (rank 6) | **Rule 8**<br>**If**<br>Trigger Conditions:<br>air preheater max time since last blow > threshold<br>Enabling Conditions:<br>air preheater media is available<br>opacity is not high<br>**Then**<br>Proposed Action:<br>clean air preheater (rank 8) |

FIG. 5B

| PROPOSE RULES | |
|---|---|
| **Rule 9**<br>**If**<br>Trigger Conditions:<br>economizer max time since last blow > threshold<br>Enabling Conditions:<br>air preheater media is available<br>opacity is not high<br>unit is above minimum load<br>**Then**<br>Proposed Action:<br>clean economizer (rank 8) | **Rule 11**<br>**If**<br>Trigger Conditions:<br>reheat temperature < threshold<br>Enabling Conditions:<br>convection media is available<br>opacity is not high<br>unit is above minimum load<br>**Then**<br>Proposed Action:<br>clean reheat zone (rank 10) |
| **Rule 10**<br>**If**<br>Trigger Conditions:<br>superheat temperature < threshold<br>Enabling Conditions:<br>convection media is available<br>unit is above minimum load<br>**Then**<br>Proposed Action:<br>clean superheat zone (rank 9) | **Rule 12**<br>**If**<br>Trigger Conditions:<br>superheat max time since last blow > threshold<br>Enabling Conditions:<br>convection media is available<br>unit is above minimum load<br>**Then**<br>Proposed Action:<br>clean superheat zone (rank 11) |

FIG. 5C

| PROPOSE RULES | |
|---|---|
| **Rule 13**<br>**If**<br>Trigger Conditions:<br>reheat max time since last blow > threshold<br>Enabling Conditions:<br>convection media is available<br>opacity is not high<br>unit is above minimum load<br>**Then**<br>Proposed Action:<br>clean reheat zone (rank 12) | **Rule 15**<br>**If**<br>Trigger Conditions:<br>dollarized effect of cleaning the furnace > threshold<br>Enabling Conditions:<br>furnace min time since last blow > threshold<br>furnace media is available<br>unit is above minimum load<br>**Then**<br>Proposed Action:<br>clean furnace zone (rank = dollarized effect of cleaning the furnace) |
| **Rule 14**<br>**If**<br>Trigger Conditions:<br>furnace max time since last blow > threshold<br>Enabling Conditions:<br>furnace media is available<br>unit is above minimum load<br>**Then**<br>Proposed Action:<br>clean furnace zone (rank 13) | **Rule 16**<br>**If**<br>Trigger Conditions:<br>dollarized effect of cleaning the superheat zone > threshold<br>Enabling Conditions:<br>superheat min time since last blow > threshold<br>convection media is available<br>unit is above minimum load<br>**Then**<br>Proposed Action:<br>clean superheat zone (rank = dollarized effect of cleaning the superheat zone) |

FIG. 5D

| PROPOSE RULES |
| --- |
| **Rule 17** |
| **If**<br>Trigger Conditions:<br>dollarized effect of cleaning the reheat zone > threshold<br>Enabling Conditions:<br>reheat min time since last blow > threshold<br>convection media is available<br>opacity is not high<br>unit is above minimum load<br>**Then**<br>Proposed Action:<br>clean reheat zone (rank = dollarized effect of cleaning the reheat zone) |

FIG. 5E

APPLY RULES

Rule 1

If
a proposed action with a fixed rank exists
Then
select the action with the highest fixed rank
Else
select the proposed action with the highest dollarized rank

FIG. 6

SOOTBLOWING OPTIMIZATION FOR IMPROVED BOILER PERFORMANCE

RELATED APPLICATIONS

This application is a divisional of U.S. application Ser. No. 11/868,021, filed Oct. 5, 2007, (issued as U.S. Pat. No. 8,340,824 on Dec. 25, 2012), which is fully incorporated herein by reference.

GOVERNMENT LICENSE RIGHTS

The U.S. Government has a paid-up license in this invention and the right in limited circumstances to require the patent owner to license others on reasonable terms as provided for by the terms of Contract No. DE-FC26-04NT41768, awarded by the United States Department of Energy.

FIELD OF THE INVENTION

The present invention relates generally to the operation of a fossil fuel-fired (e.g., coal-fired) boiler that is typically used in a power generating unit of a power generation plant, and more particularly to a system for optimizing soot cleaning sequencing and control in a fossil fuel-fired boiler.

BACKGROUND OF THE INVENTION

The combustion of coal and other fossil fuels in a power generating unit causes buildup of combustion deposits (e.g., soot, ash and slag) in the boiler, including boiler heat transfer surfaces. Combustion deposits generally decrease the efficiency of the boiler, particularly by reducing heat transfer. When combustion deposits accumulate on the boiler tubes, the heat transfer efficiency of the tubes decreases, which in turn decreases boiler efficiency. To maintain a high level of boiler efficiency, the heat transfer surfaces of the boiler are periodically cleaned by directing a cleaning medium (e.g., air, steam, water or mixtures thereof) against the surfaces upon which the combustion deposits have accumulated.

To avoid or eliminate the negative effects of combustion deposits on boiler efficiency, the boiler heat transfer surfaces would need to be essentially free of combustion deposits at all times. Maintaining this level of cleanliness would require virtually continuous cleaning. However, this is not practical under actual operating conditions because cleaning is costly and creates wear and tear on boiler surfaces. Injection of the cleaning medium can reduce boiler efficiency and prematurely damage heat transfer surfaces, particularly if they are over cleaned. Boiler surface and water wall damage resulting from cleaning is particularly costly because correction may require an unscheduled outage of the power generating unit. Therefore, it is important that these surfaces not be cleaned unnecessarily or excessively.

Boiler cleanliness must be balanced against cleaning costs. Accordingly, power generating plants typically maintain reasonable, but less than ideal boiler cleanliness levels. Cleaning operations are regulated to maintain the selected cleanliness levels in the boiler. Different areas of the boiler may accumulate combustion deposits at various rates, and require separate levels of cleanliness and different amounts of cleaning.

The devices used for cleaning the boiler heat transfer surfaces are commonly referred to as soot cleaning devices. Fossil fuel-fired power generating units employ soot cleaning devices including, but not limited to, sootblowers, sonic devices, water lances, and water cannons or hydro jets. These soot cleaning devices use steam, water or air to dislodge combustion deposits and clean surfaces within a boiler. The number of soot cleaning devices on a given power generating unit can range from several to over a hundred. Manual, sequential and time-based sequencing of soot cleaning devices have been the traditional methods employed to improve boiler cleanliness. These soot cleaning devices are generally automated and are initiated by a master control device. In most cases, the soot cleaning devices are activated based on predetermined criteria, established protocols, sequential methods, time-based approaches, operator judgment, or combinations thereof. These methods result in indiscriminate cleaning of the entire boiler or sections thereof, regardless of whether sections are already clean, In recent years, some power generation plants have replaced manual or time-based systems with criteria-based methods, such as cleaning the boiler in accordance with maintaining certain cleanliness levels. For example, one common approach is to attempt to maintain a predefined cleanliness level by controlling the soot cleaning devices. After a soot cleaning device has cleaned a surface, one or more sensors measure the resulting heat transfer improvement and determine the effectiveness of the immediately preceding soot cleaning operation. The measured cleanliness data is compared against a predefined cleanliness model that is stored in a system processor. One or more soot cleaning operating parameters can be adjusted to alter the aggressiveness of the next soot cleaning operation. The goal is to maintain the required level of heat transfer surface cleanliness for the current boiler operating conditions while minimizing the detrimental effects of the soot cleaning operation.

Criteria-based methods for soot cleaning have some drawbacks. To implement a criteria-based method, it is often necessary to install additional hardware in the boiler, such as heat flux sensors. In addition, cleanliness models are needed to adjust the performance of the soot cleaning control system. Developing these models can be challenging since the models are typically based upon rigorous first principle equations. Finally, criteria-based methods focus on cleaning specific zones in the boiler, rather than improving overall boiler performance.

Boiler operation is generally governed by one or more boiler performance goals. Boiler performance is usually characterized in terms of heat rate, capacity, emissions (e.g., NOx and CO), and other parameters. One principle underlying a soot cleaning operation is to maintain the boiler performance goals. The above-described criteria-based methods do not relate boiler performance to a required level of heat transfer surface cleanliness and, therefore, to optimum operating parameters. The approach assumes that the optimal cleanliness of an area in the boiler is known (e.g., entered by an operator). Accordingly, the approach assumes that required cleanliness levels for desired boiler performance goals are determined separately and provides no mechanism for selecting cleanliness levels for individual heating zones of the boiler. A criteria-based soot cleaning control system does not relate operational settings to boiler performance targets.

The present invention provides a soot cleaning control system that overcomes the drawbacks discussed above, as well as other drawbacks of prior art soot cleaning control systems.

SUMMARY OF THE INVENTION

In accordance with the present invention, there is provided a method for optimizing soot cleaning operations in a boiler of a power generating unit. The method includes the steps of:

selecting a zone within a boiler for a soot cleaning operation; selecting at least one soot cleaning device within the selected zone; and activating the at least one selected soot cleaning device.

In accordance with another aspect of the present invention, there is provided a soot cleaning optimization system comprising: a soot cleaner zone selection component for selecting a zone within a boiler for a soot cleaning operation; and a soot cleaning device selection component for selecting at least one soot cleaning device within the zone for activation.

An advantage of the present invention is the provision of a soot cleaning control system that includes the use of boiler performance goals in a process for selecting soot cleaning devices for activation.

Another advantage of the present invention is the provision of a soot cleaning control system that includes a zone selection component for selecting a zone in the boiler for a soot cleaning operation and a soot cleaning selection component for selecting specific soot cleaning device(s) within the selected zone for activation.

These and other advantages will become apparent from the following description taken together with the accompanying drawings and the appended claims.

BRIEF DESCRIPTION OF THE DRAWINGS

The invention may take physical form in certain parts and arrangement of parts, an embodiment of which will be described in detail in the specification and illustrated in the accompanying drawings which form a part hereof, and wherein:

FIGS. 5A-5E show a sample list of propose rules used by the sootblower zone selection component of FIG. 2;

FIG. 6 shows a sample apply rule used by the sootblower zone selection component of FIG. 2;

DETAILED DESCRIPTION OF THE INVENTION

The present invention is described herein with reference to "sootblowers" and the operation of "sootblowing." However, it should be understood that the term "sootblower" as used herein refers to soot cleaning devices of all forms. Similarly, the term "sootblowing" as used herein refers to the soot cleaning operations associated with said soot cleaning devices.

Figure 1:
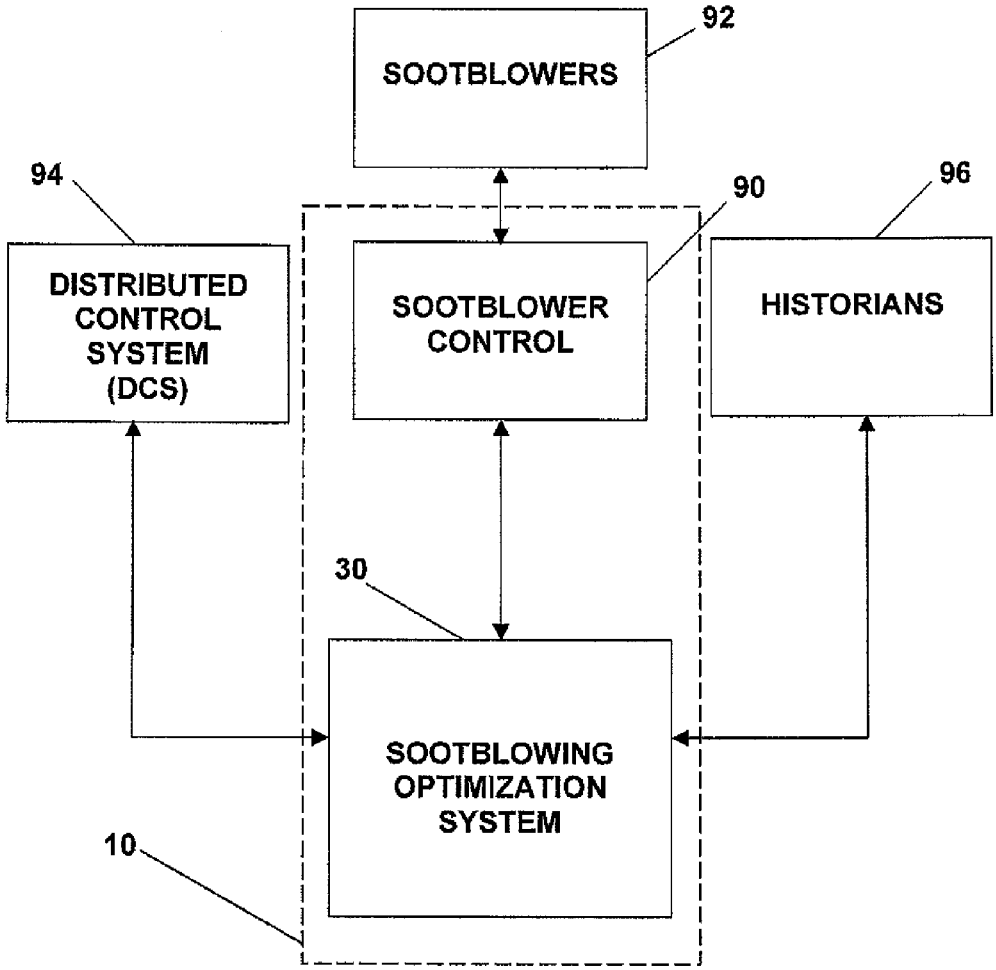
FIG. 1 is a block diagram of a sootblowing control system, including a sootblowing optimization system and sootblower control.

Referring now to the drawings wherein the showings are for the purposes of illustrating an embodiment of the present invention only and not for the purposes of limiting same, FIG. 1 shows a block diagram of a sootblowing control system 10 according to an embodiment of the present invention. Sootblowing control system 10 is generally comprised of a sootblowing optimization system 30 and sootblower control 90. As illustrated in FIG. 1, sootblowing control system 10 communicates with sootblowers 92, and other system components commonly used in power generation plants. Other system components may include, but are not limited to, a distributed control system (DCS) 94, plant data historians 96, sensor/measurement systems (not shown), pre-combustion systems (not shown), post-combustion systems (not shown), and a combustion optimization system (not shown). Additional system components have been omitted from FIG. 1 for the purpose of simplification, in order to more clearly illustrate the present invention.

Distributed Control System (DCS) 94 is a computer system that provides control of the combustion process by operation of system devices, including, but not limited to, valve actuators for controlling water and steam flows, damper actuators for controlling air flows, and belt-speed control for controlling flow of coal to mills. Sensors (including, but not limited to, oxygen analyzers, thermocouples, resistance thermal detectors, pressure sensors, and differential pressure sensors) sense parameters associated with the boiler and provide input signals to DCS 94. Historians 96 may take the form of a short term or long term historical database or retention system, and may include data that is manually or automatically recorded.

Sootblowers 92 refers to devices used for cleaning boilers (e.g., boiler heat transfer surfaces), including, but not limited to, sootblowers, sonic devices, water lances, and water cannons or hydro-jets. One or more sootblowers 92 are associated with one or more "zones" of a boiler. By way of example, and not limitation, a boiler may be divided into the following zones: furnace, reheat, superheat, economizer, and air preheater.

Sootblower control 90 provides direct control of sootblowers 92 and provides sootblowing optimization system 30 with operational data (e.g. flow, current, duration, mode, state, status, time, etc.) associated with sootblowers 92.

Sootblowing optimization system 30 may be configured and implemented in a general modeling and optimization software product (e.g., ProcessLink® from NeuCo, Inc.) The general modeling and optimization software product may be executed on a conventional computer workstation or server, and includes unidirectional or bi-directional communications interfaces allowing direct communications with sootblower control 90, DCS 94, historians 96 and programmable logic controllers (PLCs).

Using the communications interfaces, sootblowing optimization system 30 collects data indicative of operating conditions of the power generating unit, including, but not limited to, operating conditions associated with sootblowers 92 and the boiler (i.e., boiler parameters). The data indicative of operating conditions is used to update a set of state variables associated with sootblowing control system 10. These state variables store data, such as the time since last activation of each sootblower 92, and the frequency of activation over pre-determined time periods for each sootblower 92.

Figure 2:
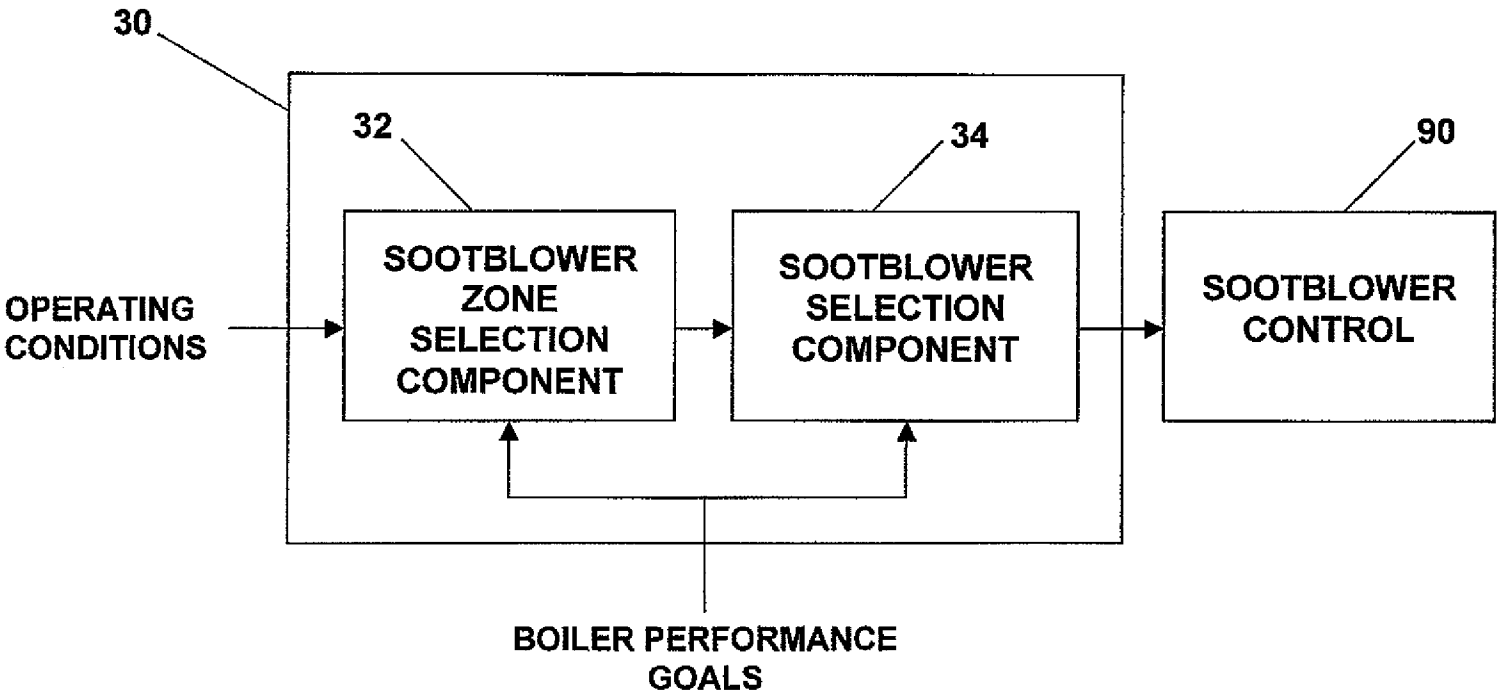
FIG. 2 is a block diagram of a sootblowing control system including a sootblowing optimization system comprised of a sootblower zone selection component and a sootblower selection component, according to a first embodiment of the present invention.

Referring now to FIG. 2, there is shown a block diagram overview of sootblowing optimization system 30, according to an embodiment of the present invention. The operating conditions (including the state variables) are input to a sootblower zone selection component 32 that is used to determine which boiler zone to clean. Once the boiler zone has been determined, a sootblower selection component 34 is used to determine which sootblower 92 or set of sootblowers 92 to activate within the boiler zone selected by sootblower zone selection component 32. As will be explained in further detail below, sootblower selection component 34 includes an optimization algorithm that uses predictive models for sootblower selection. The optimization algorithm selects the sootblower(s) 92 that is expected to provide the best boiler performance in the future based upon current operating conditions.

Figure 4:
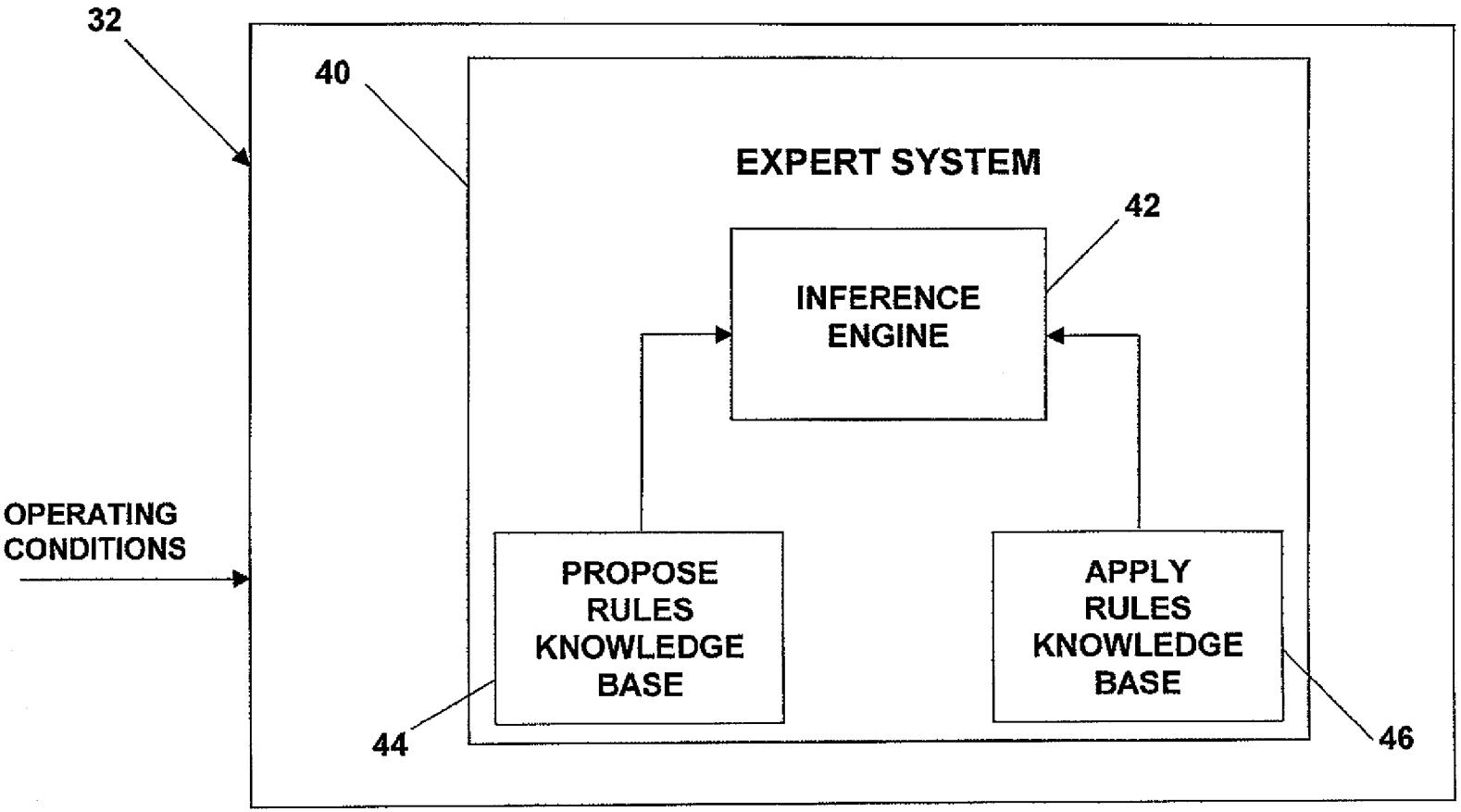
FIG. 4 is a detailed block diagram of the sootblower zone selection component of FIG. 2.

FIG. 4 illustrates a detailed block diagram of sootblower zone selection component 32 of sootblowing optimization system 30. The function of sootblower zone selection component 32 is to determine the best boiler zone to clean, given current operating conditions. Sootblower zone selection component 32 determines the boiler zone to be cleaned by use of an expert system 40. Expert system 40 is comprised of three primary components, namely, an inference engine 42, a knowledge base 44 comprised of propose rules and a knowledge base 46 comprised of apply rules. Inference engine 42 allows sootblowing optimization system 30 to achieve prioritized actions based on the propose rules of knowledge base 44 and the apply rules of knowledge base 46. The propose and apply rules of knowledge bases 44 and 46 may be determined through expert knowledge sources, such as application engineers, textbooks and journals.

The propose rules of knowledge base 44 are used to determine one or more proposed actions for addressing various issues relating to boiler performance (e.g., boiler efficiency). At least one trigger condition (i.e., condition(s) associated with a boiler performance issue), at least one enabling condition (i.e., condition(s) for determining whether sootblowing can be currently initiated in a particular zone), and a proposed action (with associated rank) are associated with each propose rule. Inference engine 42 evaluates all of the propose rules of knowledge base 44 to determine a generated list of proposed actions. Inference engine 42 adds a proposed action to the generated list of proposed actions only if all of the following are satisfied: (a) the trigger condition(s) associated with a propose rule and (b) the enabling condition(s) associated with a propose rule.

FIGS. 5A-5E illustrate a sample set of propose rules (i.e., rules 1-17). Rules 1-14 of the propose rules are examples of "fixed rank" rules, while rules 15-17 of the propose rules are examples of "monetary rank" rules. Fixed rank rules have a proposed action that is associated with a rank having an assigned fixed value. Monetary rank rules have a proposed action that is associated with a rank having a value determined by economic savings, as will be described in further detail below.

With reference to the first propose rule (i.e., rule 1) shown in FIG. 5A, rule 1 has the proposed action of cleaning the furnace zone. The superheat sprays, superheat temperature and reheat temperature must be above respective thresholds in order to satisfy the trigger conditions of rule 1. The enabling conditions of rule 1 are satisfied only if: (1) the amount of time elapsing since the last sootblowing operation in the furnace zone is greater than a threshold time, (2) the furnace media is available, and (3) the load of the power generating unit is above a minimum load value. If all of the trigger conditions and all the enabling conditions associated with rule 1 are met, then the proposed action associated with rule 1 is added to the generated list of proposed actions.

Inference engine 42 evaluates the apply rule(s) of knowledge base 46 to select a proposed action from the generated list of proposed actions. With reference to rule 1 of the sample apply rules (FIG. 6), a proposed action associated with a "fixed rank" rule is selected as an action in the event that the generated list of proposed actions includes at least one proposed action associated with a "fixed rank" rule. In accordance with rule 1 of the apply rules, inference engine 42 will select from the generated list the "fixed rank" proposed action that has the highest rank.

For example, if only propose rules 1, 2 and 15 (FIGS. 5A and 5D) are satisfied, only the proposed actions of propose rules 1, 2 and 15 will be included in the generated list of proposed actions. Application of apply rule 1 (FIG. 6) selects the proposed action of propose rule 1 (i.e., cleaning the furnace zone) from the generated list of proposed actions, since the proposed action of propose rule 1 is "fixed rank" and has the highest rank (i.e., rank 1).

It should be understood that a trigger condition associated with a propose rule may also take into consideration whether a dollarized (i.e., monetary) effect of cleaning a zone (e.g., furnace zone) will yield predicted cost savings that exceed a predetermined threshold value. For example, propose rule 15 (FIG. 5D) has a trigger condition that requires the dollarized effect of cleaning the furnace to exceed a threshold value.

Furthermore, as indicated above, a proposed action may have an associated "monetary rank." For example, proposed rule 15 (FIG. 5D) has a proposed action having a monetary rank defined by the dollarized (i.e., monetary) effect of cleaning the furnace zone. Accordingly, the rank associated with the proposed action of propose rule 15 has a value determined by the predicted cost savings of cleaning the furnace zone.

In the illustrated embodiment, the value of the dollarized (i.e., monetary) effect of cleaning a particular zone is determined by using a model that predicts the effects on NOx emissions and heat rate associated with cleaning the particular zone. The predicted change in NOx emissions and heat rate is multiplied by the current NOx credit value and fuel costs to determine the cost savings associated with the cleaning event. Therefore, a "monetary rank" associated with a proposed action is equal to an expected cost savings, i.e., the dollarized effect of cleaning a particular zone.

An apply rule can also be based upon a dollarized (i.e., monetary) effect of a proposed action. For example, apply rule 1 (FIG. 6) will select the proposed action with the highest monetary (i.e., dollarized) rank if no proposed action with a fixed rank is among the generated list of proposed actions.

Propose rules 15-17 (FIGS. 5D-5E) illustrate rules that represent cost savings of cleaning different regions of a boiler. The proposed actions of propose rules 15-17 have a "monetary rank" that is based on a dynamically determined cost savings rather than on a fixed order (i.e., "fixed rank").

The proposed action of propose rule 15 (i.e., cleaning the furnace zone) is added to the generated list of proposed actions only if both the trigger conditions (i.e., the dollarized effect of cleaning the furnace is greater than a dollar threshold) and the three (3) enabling conditions are met. The rank of the proposed action of rule 15 is equal to the dollarized effect of cleaning the furnace. Likewise, the proposed action of propose rules 16 and 17 are added to the generated list of proposed actions if associated trigger and enabling conditions are met.

If only propose rules 15, and 16 (FIG. 5D) are satisfied, only the proposed actions of propose rules 15 and 16 are included in the generated list of proposed actions. Application of apply rule 1 (FIG. 6) selects the proposed action of the generated list having the highest monetary rank. Therefore, if the proposed action of propose rule 16 has the greatest cost savings (i.e., highest monetary rank) then the proposed action of propose rule 16 is selected by apply rule 1.

An advantage of the propose-apply approach described above is that the apply rules can be used to effectively combine propose rules. For example, if the same action is proposed by multiple propose rules, the rank of a proposed action can be re-evaluated by an apply rule and selected if its rank is higher than the rank of any other proposed action.

Another advantage of the propose-apply approach described above is that the apply rules can be adaptive or based on neural network model(s). For example, sootblowing optimization system 30 can dynamically adjust the ranks associated with proposed actions based on boiler performance. Alternatively, neural network models may be used to determine the effects of cleaning a zone on boiler performance. The resulting boiler performance can then be used to adjust the ranks of the proposed actions. By separating inferencing into two sets of rules (i.e., propose and apply), sootblowing optimization system 30 provides great flexibility for appropriately selecting the zone to clean in a boiler.

Expert system 40 of the present invention provides several advantages:

(1) Prioritizing Proposed Actions: Engineers can specify an a priori ordering of the various proposed actions that can be taken. Because priorities may change based upon current operating conditions, the rank associated with a proposed action can be dynamically changed at run-time by the sootblowing optimization system 30 using the apply rules.

(2) Rules Design: To simplify knowledge capture, engineers only needed to collect propose and apply rules. Also, it is possible to add rules at any time to rules database 46 in order to improve performance.

(3) Demystification: Using an inference engine, the conditions that result in the selection of a zone to be cleaned may be displayed to a user on a computer interface (e.g., a computer monitor). Thus, the expert system approach of the present invention can provide transparency into the operation of the zone selection algorithm.

Figure 7:
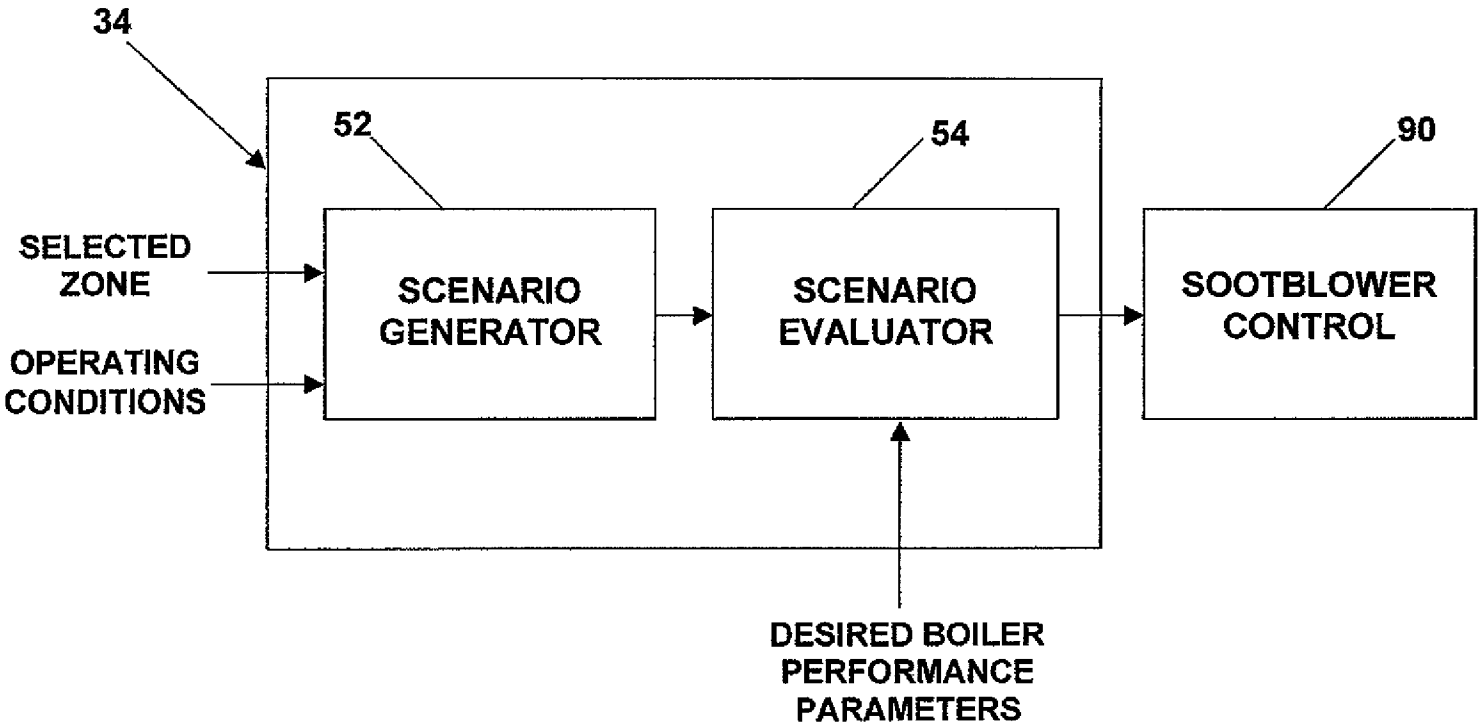
FIG. 7 is a detailed block diagram of the sootblower selection component of FIG, 2, including a scenario generator and a scenario evaluator.

Following determination by sootblower zone selection component 32 of a selected boiler zone for sootblowing, sootblower selection component 34 is used to determine which sootblower(s) 92 to activate within the selected boiler zone. Sootblower selection component 34 will now be described in detail with reference to FIGS. 7-9. FIG. 7 illustrates a block diagram of sootblower selection component 34 that includes a scenario generator 52 and a scenario evaluator 54. Scenario generator 52 creates a complete set of sootblowing scenarios for the selected zone given current operating conditions. Scenario evaluator 54 then determines which scenario (i.e., sootblower activation) results in the best predicted future boiler performance.

Figure 8:
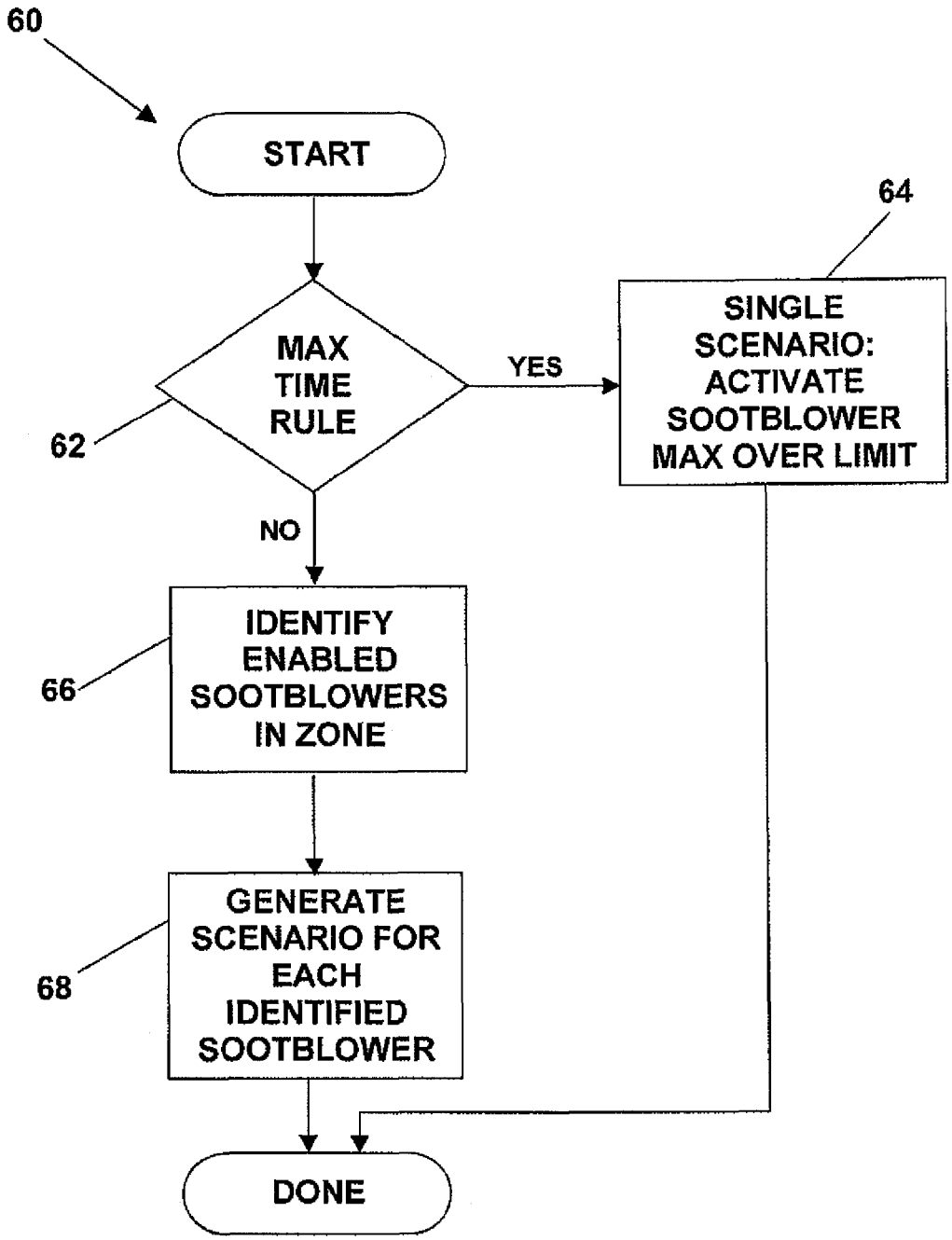
FIG. 8 is a flow chart for operation of the scenario generator of the sootblower selection component.

FIG. 8 provides a flow chart 60 of the operation of scenario generator 52. Scenario generator 52 first determines if any of the sootblowers within the selected zone have violated a maximum time limit since last blowing (step 62). If only one sootblower is in violation, this sootblower is selected for activation and a single scenario is generated (step 64). If multiple sootblowers within the selected zone have violated the maximum time limit, the sootblower that is most over the maximum time limit is typically selected for activation. By monitoring time limits, sootblower optimization system 30 guarantees that any related constraints are observed before attempting to optimize performance.

If no time limits have been violated by the sootblowers within the selected zone, scenario generator 52 identifies all sootblowers that can be activated using the enabling conditions described above (step 66). Next, a scenario is generated for activating each identified sootblower (step 68). For example, if three sootblowers in the selected zone are enabled, then three separate scenarios would be generated for activating each of these sootblowers. At the end of the scenario generation, a set of activation scenarios are available for evaluation.

Each scenario generated by scenario generator 52 includes a list of the history of sootblowing activations, such as time since start of last activation of each sootblower. In addition, the scenario may contain data associated with current operating conditions, such as load. In each scenario, a sootblower is selected for activation by scenario generator 52. Therefore, the history of activation associated with that sootblower is modified to reflect activating (i.e., turning on) the sootblower at current time (i.e., time since last activation is modified to be equal to zero).

It should be understood that foregoing references to a single "sootblower" may also refer to a set of sootblowers. Therefore, more than one sootblower may be activated in association with each individual scenario at steps 64 and 68.

Figure 9:
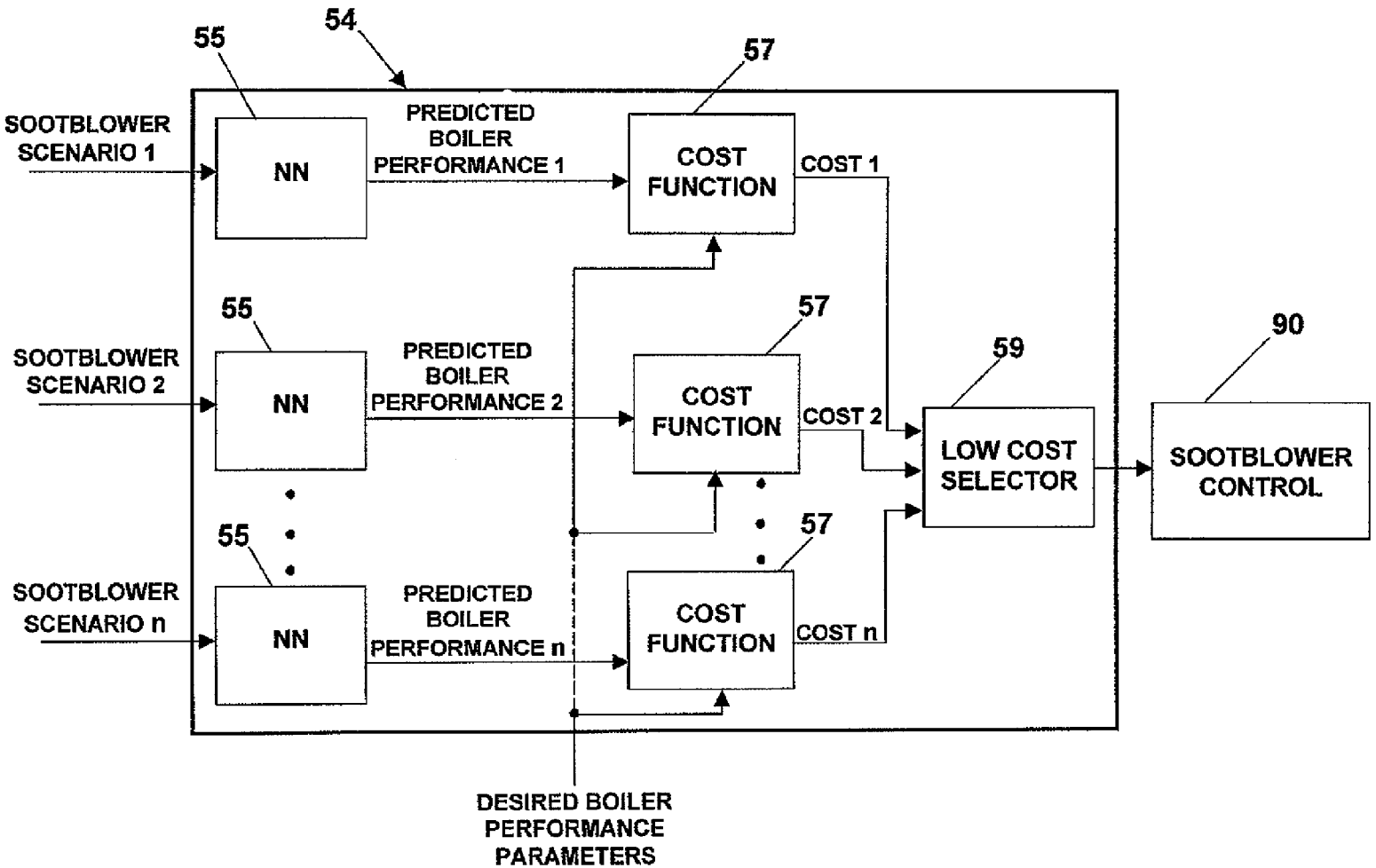
FIG. 9 is a detailed block diagram of the scenario evaluator of the sootblower selection component, the scenario evaluator determining sootblower activation within a selected boiler zone that minimizes a user-specified cost function.

FIG. 9 provides a detailed block diagram of scenario evaluator 54. Each of the sootblower scenarios identified by scenario generator 52 (i.e., sootblower scenarios 1 to n) is input to a neural network (NN) model 55 that is used to predict future boiler performance. Scenario evaluator 54 is used to determine the sootblower activation that minimizes a user-specified cost function.

Scenario evaluator 54 predicts how activating different sootblowers within a zone will affect boiler performance factors, such as heat rate and NOx. An identical neural network model 55 is used to predict the effects of activations on boiler performance. Model 55 is trained upon historical data over a significant period of time. In addition, model 55 is preferably automatically retuned daily so that any changes in boiler performance can be considered in the latest blower selection.

As shown in FIG. 9, predicted boiler performance parameters for each sootblower scenario and the desired boiler performance parameters are inputs to a cost function 57 that is used to compute a cost associated with the sootblower scenario. Cost function 57 may represent the "actual" cost associated with boiler performance or an "artificial" cost used to achieve a user specified boiler performance. For example, cost function 57 may be used to compute the cost of the predicted fuel usage and NOx production. (In this case, heat rate, load, fuel cost and NOx credit price are needed to compute these costs.) Alternatively, cost function 57 may be constructed so that heat rate is minimized while NOx is maintained below a user-defined level. Cost function 57 is designed such that a lower cost represents better overall boiler performance.

Scenario evaluator 54 computes the cost of each scenario (i.e., COST 1 to COST n) using cost function 57. Low cost selector 59 identifies the scenario with the lowest cost. Thereafter, the one or more sootblowers 92 (i.e., single sootblower or set of sootblowers) associated with the scenario having the lowest cost is activated through the communications interfaces of sootblowing control system 10. After activation of the selected sootblower(s) 92, sootblowing control system 10 waits a predetermined amount of time before re-starting the sootblower selection cycle discussed above. Accordingly, sootblowing control system 10 achieves optimal sootblowing and selects the lowest cost scenario that observes all system constraints.

Figure 3:
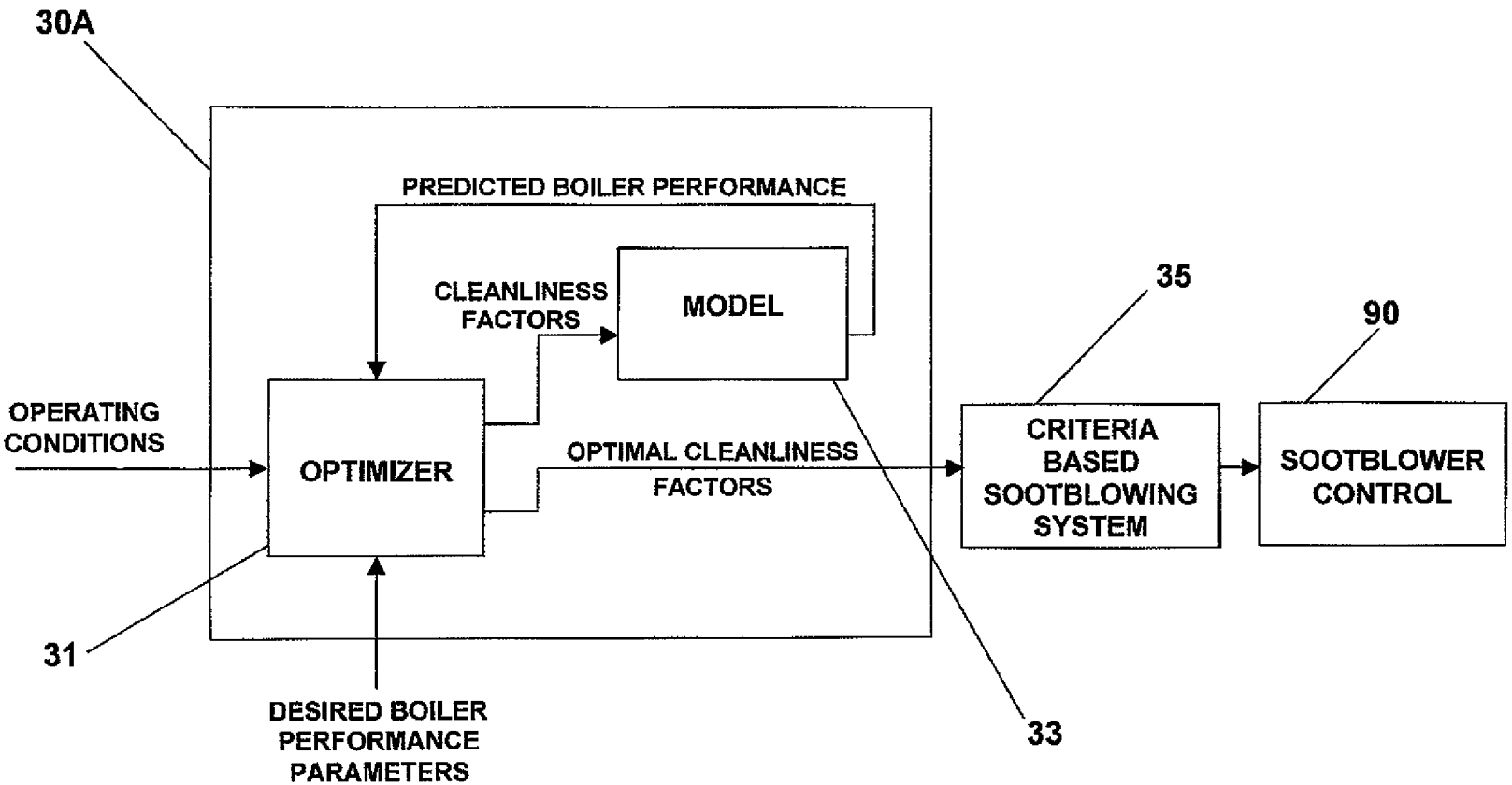
FIG. 3 is a block diagram of a sootblowing control system including a sootblowing optimization system for providing optimal cleanliness factors to a criteria-based sootblowing system, in accordance with an alternative embodiment of the present invention.

Referring now to FIG. 3, there is shown a sootblowing control system according to an alternative embodiment of the present invention. In this alternative embodiment, the sootblowing control system is comprised of a sootblowing optimization system 30A and a conventional criteria-based sootblowing system 35. Sootblowing optimization system 30A includes an optimizer 31 and a system model 33. In the illustrated embodiment, model 33 is a neural network based model that determines the effects of varying the cleanliness factors on boiler performance parameters (e.g., heat rate and NOx). Optimizer 31 receives data indicative of operating conditions and desired boiler performance. Sootblowing optimization system 30A uses optimizer 31 and model 33 to determine optimal cleanliness factors based upon desired boiler parameters. The optimal cleanliness factors are provided to criteria-based sootblowing system 35.

In still another alternative embodiment of the present invention, sootblowing control system 10 may be combined with other optimization systems, such as a combustion optimization system (e.g., CombustionOpt from NeuCo, Inc.), to improve boiler performance. For example, the combustion optimization system may adjust a boiler's fuel and air biases to lower NOx and improve heat rate. The combustion optimization system computes the resulting fuel and air biases and inputs them to sootblowing optimization system 30, which then takes the effects of these changes into account when determining an optimal sootblowing sequence. Similarly, the sootblowing sequences (i.e., sootblower activation) determined by sootblowing optimization system 30 can be input into the combustion optimization system so that sootblowing effects are taken into account when adjusting fuel and air biases in the boiler.

In summary, sootblowing control system 10 is an intelligent sootblowing system that controls the activation of individual sootblowers based upon expected improvements in boiler performance. Sootblowing optimization system 30 is comprised of two primary components, namely, one that selects which zone in the boiler to clean (i.e., sootblower zone selection component 32) and one that determines the best sootblower or set of sootblowers to activate (i.e., sootblower selection component 34) within the zone. Sootblower zone selection component 32 is based upon use of an expert system 40. Expert system 40 has a propose rules knowledge base 44 and an apply rules knowledge base 46. The propose rules propose actions to address current issues and the apply rules are used to determine which of the proposed actions of a generated list of proposed actions is the optimal action to take to address the current issues.

Within a selected zone, sootblowing optimization system 30 determines scenarios for activating different sootblowers. Using neural network models, sootblowing optimization system 30 evaluates each scenario and determines the expected (i.e., predicted) boiler performance associated with each scenario. Sootblowing optimization system 30 then uses the best expected boiler performance scenario to determine which sootblower or set of sootblowers to activate within the zone. This approach allows the user to formulate both the rules in the sootblowing control system as well as criteria for optimal performance.

It should be appreciated that different variations of sootblowing control system 10 can be deployed based upon requirements. For instance, the sootblowing optimization system may alternatively be used to provide optimal cleanliness factors in connection with a conventional criteria-based sootblowing system, as discussed above in connection with FIG. 3. As also mentioned above, sootblowing optimization system of the present invention can be integrated with other optimizer systems, such as a combustion optimization system (e.g., CombustionOpt® from NeuCo., Inc.). For example, sootblower activations can be input into the combustion optimization system allowing for fuel and air staging to be automatically adjusted in anticipation of the effects of sootblowing. By coordinating actions between the sootblowing and combustion optimizers, power generation plants can realize greater benefits.

Other modifications and alterations will occur to others upon their reading and understanding of the specification. It is intended that all such modifications and alterations be included insofar as they come within the scope of the invention as claimed or the equivalents thereof.

Having described the invention, the following is claimed:

1. A computer-based soot cleaning optimization system for optimizing soot cleaning operations in a boiler of a power generating unit, wherein the boiler is divided into a plurality of zones, the system comprising:

a zone selection component for receiving current operating conditions of the power generating unit that include current operating conditions associated with soot cleaning devices and the boiler, and for selecting one of said plurality of zones of the boiler for a soot cleaning operation given said current operating conditions of the power generating unit, wherein said zone selection component includes an expert system comprised of:

an inference engine, a first knowledge base comprising a plurality of propose rules, wherein each of said plurality of propose rules has associated therewith: (a) one or more trigger conditions, (b) one or more enabling conditions indicative of whether soot cleaning can be currently initiated in a zone of the boiler, and (c) a proposed action having an associated rank, and a second knowledge base comprising a plurality of apply rules;

said zone selection component programmed to select one of said plurality of zones of the boiler by executing the following steps:

accessing the expert system;

using the inference engine for evaluating the plurality of propose rules to generate a list of proposed actions for achieving boiler performance goals for operation of the boiler, wherein each proposed action identifies a zone for a soot cleaning operation, wherein the proposed action associated with a propose rule is added to the generated list of proposed actions only when the following conditions are satisfied: (a) the trigger conditions associated with the propose rule and (b) the enabling conditions associated with the propose rule, and wherein satisfaction of the trigger conditions and enabling conditions are determined using the current operating conditions transmitted by the communications interfaces;

using the inference engine for evaluating the plurality of apply rules of the second knowledge base to select one proposed action from the generated list of one or more proposed actions determined by evaluating the plurality of propose rules, wherein said one proposed action is selected from the generated list of proposed actions according to the rank associated with each proposed action; and a soot cleaning device selection component for selecting at least one soot cleaning device within the zone identified by the selected proposed action.

2. A computer-based soot cleaning optimization system according to claim 1, wherein said trigger conditions are associated with at least one of the following: (1) boiler performance, or (2) a monetary effect of cleaning a zone yielding a predicted cost savings.

3. A computer-based soot cleaning optimization system according to claim 1, wherein at least one of said apply rules is based upon a monetary effect of a proposed action on the operation of said power generating unit.

4. A computer-based soot cleaning optimization system according to claim 1, wherein said computer-based soot cleaning optimization system uses said apply rules to dynamically adjust ranks associated with the proposed actions based on their expected impact on boiler performance.

5. A computer-based soot cleaning optimization system according to claim 1, wherein said apply rules are based on a neural network model.

6. A computer-based soot cleaning optimization system according to claim 5, wherein said neural network model determines effects on boiler performance resulting from cleaning a boiler zone.

7. A computer-based soot cleaning optimization system according to claim 6, wherein said computer-based optimization system adjusts ranks associated with the proposed actions in accordance with said effects on boiler performance, as determined by said neural network model.

8. A computer-based soot cleaning optimization system according to claim 1, wherein said rank associated with each proposed action is a fixed rank having an assigned fixed value.

9. A computer-based soot cleaning optimization system according to claim 1, wherein said rank associated with each proposed action is a monetary rank indicative of cost savings for operation of said power generating unit.

10. A computer-based soot cleaning optimization system according to claim 1, wherein said soot cleaning device selection component includes:

a scenario generator for generating one or more soot cleaning scenarios for activating one or more soot cleaning devices within the selected zone in accordance with current operating conditions; and a scenario evaluator for determining which of said one or more soot cleaning scenarios results in best predicted future boiler performance.

11. A computer-based soot cleaning optimization system according to claim 10, wherein said scenario evaluator includes:

a neural network (NN) model for predicting boiler performance for each of said one or more soot cleaning scenarios; and a cost function for determining a cost associated with each of the one or more soot cleaning scenarios.

12. A computer-based soot cleaning optimization system according to claim 10, wherein said soot cleaning device selection component is programmed to select said at least one soot cleaning device within the selected zone by:

using said scenario generator to generate said one or more soot cleaning scenarios, wherein for each scenario one or more soot cleaning devices are activated within the selected zone in accordance with said current operating conditions;

using the scenario evaluator to determine which of said one or more soot cleaning scenarios results in a best predicted future boiler performance; and selecting one or more soot cleaning devices for activation according to the soot cleaning scenario resulting in the best predicted future boiler performance.

13. A computer-based soot cleaning optimization system according to claim 12, wherein said one or more soot cleaning scenarios are generated with consideration of one or more constraints on said soot cleaning devices.

14. A computer-based soot cleaning optimization system according to claim 13, wherein said one or more constraints include time limits since last activation of said soot cleaning devices.

15. A computer-based soot cleaning optimization system according to claim 10, wherein said scenario evaluator includes:

a neural network (NN) model for predicting boiler performance for each of said one or more soot cleaning scenarios; and a cost function for determining a cost associated with each of the one or more soot cleaning scenarios, wherein said scenario evaluator determines which of said one or more soot cleaning scenarios results in the best predicted future boiler performance by:

inputting each of the one or more soot cleaning scenarios into the neural network (NN) model;

determining a predicted boiler performance for each of the one or more soot cleaning scenarios using the respective neural network model;

determining the cost associated with each of the one or more soot cleaning scenarios using the cost function; and activating the one or more soot cleaning devices associated with the soot cleaning scenario that has the lowest cost in accordance with the cost function.

* * * * *